United States Patent [19]

Charters, III

[11] Patent Number: 4,977,625

[45] Date of Patent: Dec. 18, 1990

[54] UNDER-CUFF PROTECTIVE DEVICE

[76] Inventor: Werrett W. Charters, III, 4610 Herman St., Eugene, Oreg. 97404

[21] Appl. No.: 516,555

[22] Filed: Apr. 30, 1990

[51] Int. Cl.[5] ..... A41D 20/00

[52] U.S. Cl. ..... 2/170; 2/16; 2/162; 128/77

[58] Field of Search ..... 2/170, 16, 162, 311, 2/DIG. 6, 338; 128/77

[56] References Cited

U.S. PATENT DOCUMENTS

| | | | |
|---|---|---|---|
| 241,224 | 5/1881 | Kleinert | 2/170 |
| 856,282 | 6/1907 | Moss | 2/170 |
| 2,249,550 | 7/1941 | Williams | 2/16 |
| 2,369,115 | 2/1945 | Bloom | 2/16 |
| 2,832,074 | 4/1958 | Wheeler | 2/16 |
| 3,256,882 | 6/1966 | Huber | 2/16 |
| 4,557,215 | 12/1985 | Petersson | 2/170 |
| 4,750,218 | 6/1988 | Ziegler | 2/162 |
| 4,829,604 | 5/1989 | Allen et al. | 2/170 |
| 4,896,378 | 1/1899 | Campana | 2/16 |

*Primary Examiner*—Werner H. Schroeder
*Assistant Examiner*—G. Hale
*Attorney, Agent, or Firm*—John F. Ingman

[57] ABSTRACT

An under-cuff protective device is formed to be placed and retained between a restraining device, such as handcuffs or leg-cuffs, and the detainee. The device includes a flexible base member of a length to substantially encircle the limb, generally at the wrist or ankle. Two wall members are attached to the outside of the base member in longitudinally spaced relationship, separated so as to permit the restraining device to fit between the wall members and snugly about the base member. The wall members form a wall-like structure which retains the restraining device in place on the base member. A preferred means of forming each wall member is by longitudinally folding a portion of the base member over onto its outside surface and attaching it there. The base member is fastened about the detainee's limb using two flexible connecting straps. Hook and loop fastening means are preferred. The connecting straps may be attached to the base member so as to be vertically aligned with the wall member, thus increasing the effective height of the wall member. Each connecting strap may be attached between the base member and the wall member along the entire length of the wall member. Attachment may be by two rows of longitudinal stitching therethrough. An end of the base member with wall members attached may be bevelled so as to reduce its thickness, providing a smooth transverse transition on the inside of the device.

7 Claims, 1 Drawing Sheet

UNDER-CUFF PROTECTIVE DEVICE

BACKGROUND OF THE INVENTION

1. Field of the Invention

This invention involves an under-cuff protective device, and, more particularly, a protective device formed to encircle a wrist or ankle to provide protection thereof from damage caused by handcuffs and leg-cuffs or the like.

2. Description of the Prior Art

When restraining devices such as handcuffs or leg-cuffs are placed on a detainee, it is not uncommon for painful skin abrasions to occur. Additionally, serious and permanent damage to the radial nerve in the wrist can be caused.

There is a need, particularly with respect to psychiatric patients, who may tend to unthinkingly resist, and also with prisoners during transport, for a protective device which would be placed about the wrist, or ankle, of a person so as to provide a protective shield against the potential damaging effects of restraining devices.

SUMMARY OF THE INVENTION

The present invention provides an under-cuff protective device which meets the aforementioned need. A wrist or ankle encircling device is formed to be placed and retained between the restraining device and the detainee.

Accordingly, in the preferred embodiment, the under-cuff protective device includes a base member of soft leather or similar material of a length to substantially encircle the limb, generally at the wrist or ankle. Two wall members are attached to the outside of the base member in longitudinally spaced relationship, separated so as to permit the restraining device to fit between the wall members and snugly about the base member. The wall members thus form a wall-like structure which retains the snugly fitted restraining device in place on the base member. A preferred means of forming each wall member is by longitudinally folding a portion of the base member over onto its outside surface and attaching it there. The base member is fastened about the detainee's limb using two flexible connecting straps. Hook and loop fastening means are preferred. The connecting straps may be attached to the base member so as to be vertically aligned with the wall member, thus increasing the effective height of the wall member and enhancing the retention of the restraining device between the wall members. Each connecting strap may be attached between the base member and the wall member along the entire length of the wall member. Attachment may be made by two rows of longitudinal stitching therethrough. An end of the base member with wall members attached may be bevelled so as to reduce the thickness of a possible limb-contacting lip thereat.

DESCRIPTION OF THE PREFERRED EMBODIMENT

Figure 1:
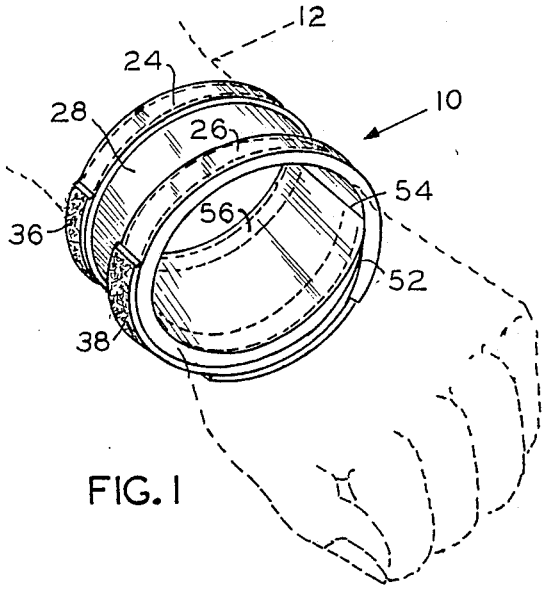
FIG. 1 illustrates a perspective view of the protective device encircling the wrist.
Figure 2:
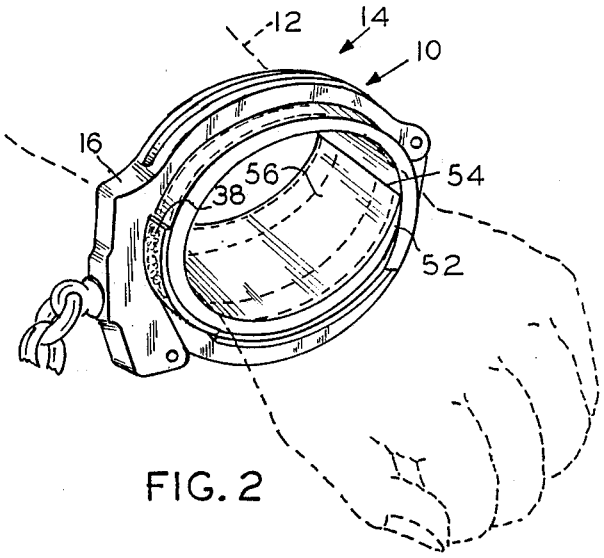
FIG. 2 illustrates a perspective view of the protective device of FIG. 1, in use with a restraining handcuff.

Turning now to the drawings, there is shown in FIG. 1 the under-cuff protective device 10 encircling a wrist 12. The drawings and following description are oriented to the use of the protective device 10 about the wrist 12 in conjuction with handcuffs 16. However, it is clear that the same protective device 10, with modified dimensions, also could be used for the identical purpose with a restraining device 14, such as leg-cuffs, which shackles the ankle (not shown). FIG. 2 illustrates the protective device 10 in combination with the restraining device 14 as handcuffs 16.

Figure 5:
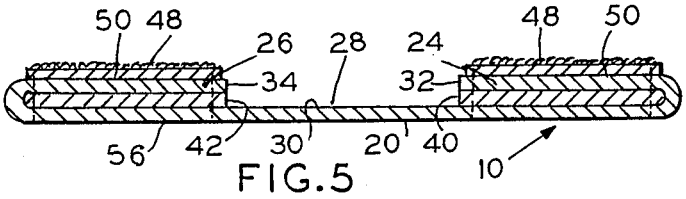
FIG. 5 illustrates a cross sectional view of the protective device, as seen at line 5—5 of FIG. 3.

The protective device 10 includes a flexible base member 20 which substantially encircles the wrist 12. On the outside 22 of the base member 20 are attached two wall members 24 and 26 which are parallel to each other and extend the length of the base member 20. As shown in FIG. 5 the wall members 24 and 26 attached to the base member 20 form a longitudinal trough 28 down the center 30 of the base member 20 which is bordered by the inside edge 32, 34 of the wall members 24 and 26. The wall members 24, 26 thus provide a wall-like restraint, formed to retain applied handcuffs 16 between the wall members 24, 26 and oriented along the trough 28 in the center 30 of the protective device 10 thereby assuring that the handcuffs 16 will remain upon the protective device 10. While separate wall members 24, 26 can be used, it has been found convenient to start with an initially wider base member 20 and fold the longitudinal edges 32 and 34 over on top of the base 20 to form the wall members 24 and 26.

The base member 20, with wall members 24, 26 attached, is fastened encircling the wrist 12 before the application of the handcuffs 16. In the preferred embodiment the means for fastening the protective device 10 includes the use of two flexible connecting straps 36 and 38 which are attached to and extend from the base member 20 in the same spaced relationship as the wall members 24, 26 so as to not interfere with the trough 28.

Figure 6:
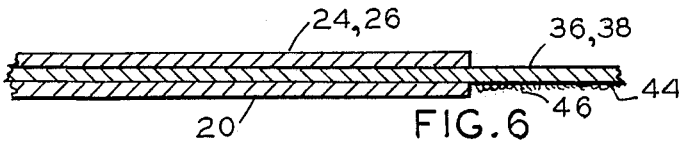
FIG. 6 illustrates a cross sectional view of the protective device, as seen at line 6—6 of FIG. 3.

The preferred connecting straps 36 and 38 may be of a width substantially equal to the width of the wall members 24, 26 and are attached between the base members 20 and the wall members 24, 26 with their inner edges 40 and 42 aligned with the inner edges 32 and 34 of the wall members 24 and 26. As illustrated in FIG. 6, such placement, with the inside edges 40 and 42 of the connecting straps 36, 38 adjacent to the inside edge 32, 34 of the wall members 24, 26, serves to increase the effective vertical height of the wall-like restraint formed by edges 32, 34.

Figure 7:
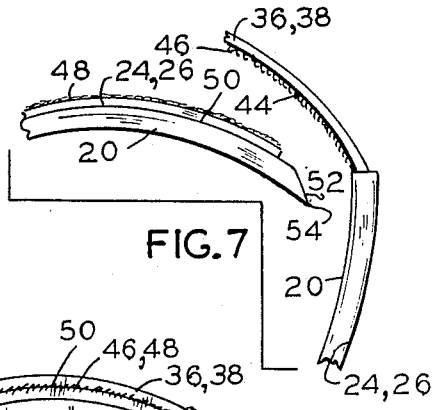
FIG. 7 illustrates the encircling fastening means of the protective device in an open position.
Figure 8:
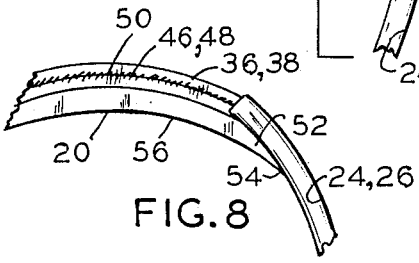
FIG. 8 illustrates the encircling fastening means of the protective device in a closed position.

The connecting straps 36, 38, following encirclement of the wrist 12, may be releasably fastened to the base member 20 by conventional means, such as buckles (not shown). Preferred, however, for fastening, is the use of hook and loop fastening means, such as VELCRO, with the underside 44 of the straps 36, 38 utilizing hook fastening material 46 and the outside 50 of the wall members 24, 26 having the loop fastening material 48 affixed thereto. As seen in FIG. 7 and FIG. 8, a connecting strap 36 or 38 thus connects to the outside 50 of the wall member 24, 26. Also seen in FIG. 7 and FIG. 8 is a preferred bevelling 52 of the end edge 54 of the protective device 10 from the outside 50 of the wall member 24, 26 to the inside 56 of the base member 20 so as to provide a smooth transverse transition on the inside 56 of the protective device 10, which otherwise could bite into the wrist 12 of the detainee.

Figure 3:
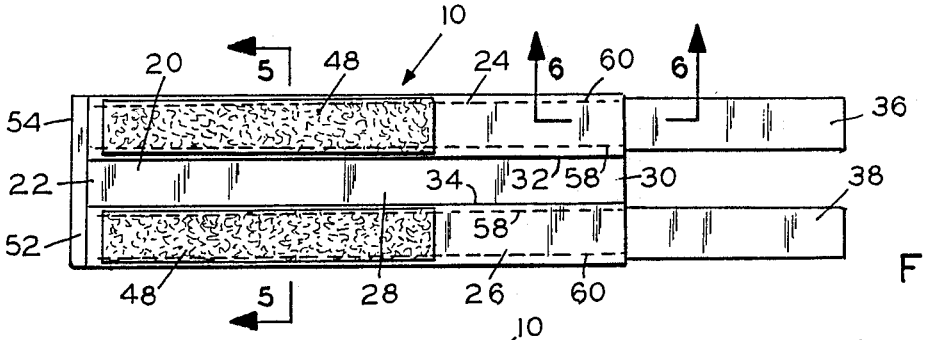
FIG. 3 shows a top plan view of the protective device, the top corresponding to the outside of the encircling protective device of FIG. 1.
Figure 4:
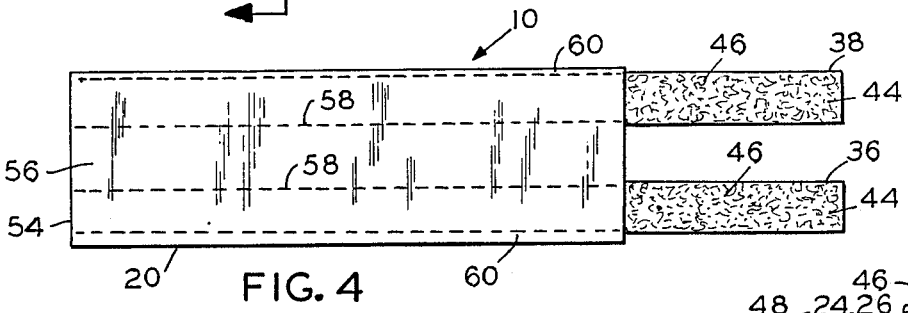
FIG. 4 shows a bottom plan view of the protective device, the bottom corresponding to the inside of the encircling protective device of FIG. 1.

The preferred means for mutually attaching the base member 20, the connecting straps 36, 38, the wall members 24, 26, and the hook and loop fastening material 48, 50 is by two separated rows of stitching 58 and 60 as best seen in FIGS. 3 and 4. Other means of attachment, to include adhesive and even rivets (not shown) have also proved to be satisfactory.

As noted previously, the protective device 10 is placed about the wrist 12 and snugly attached with the connecting straps 24 and 26. The handcuffs 16 are then applied. It should be noted that the handcuffs 16 will hold the protective device 10 in place; should the detainee manage to unfasten the connecting straps 24 and 26, he will not be able to remove the protective device 10 and thereby gain an escape advantage of looser handcuffs 16.

A protective device 10 designed for use with handcuffs 16 has been found to be excellent when the base member 20 is formed of soft leather approximately 8-inches long by 3 ¾-inches wide and 1/16-inch thick. Approximately ¾-inch is folded over on each longitudinal edge 32 and 34, thus creating a ¾-inch wide wall member 24, 26 and a ¾-inch wide longitudinal trough 28 in which the standard handcuff 16 will fit. On each side of the trough 28, the folded-over leather edges 32, 34 creates a wall of approximately 1/16-inch height, while the addition of 1/16-inch thick connecting straps 36, 38 elevates the effective vertical height of the wall to ⅛-inch. The ¾-inch doubled-over edges 32, 34 with the 2¼-inch wide inside surface 56 provides an effective protective device 10 which will not collapse or distort in use. The connecting straps 36, 38 preferably extend longitudinally from the folded base member 20 approximately 2½-inches. The loop fastening material 48, attached on the outside of the wall members 24, 26, may be approximately 5-inches in length.

As noted previously, a similar protective device 10 may be developed for leg-cuffs; the dimensions would be expected to be somewhat greater due to the greater circumference of the ankle and the possible greater width of leg-cuffs.

It is thought that the under-cuff protective device of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A protective device, in combination with restraining devices applied to limbs of the body, such as handcuffs, leg-cuffs and the like, comprising:

a. a flexible base member having a substantially limb-encircling length, a width, an inside surface, and an outside surface;

b. two wall members, attached in longitudinally parallel spaced relationship upon the outside surface of the base member, the spacing permitting the restraining device to fit between the wall members and snugly against the outside of the base member, said wall member formed to retain said snugly fitted restraining member between the wall members;

c. means for fastening the base member about a limb.

2. The protective device, as recited in claim 1, wherein a wall member is formed by longitudinally folding a portion of the width of the base member back over onto the outside surface, and attaching the folded portion thereat.

3. The protective device, as recited in claim 1, where the wall members have an outside surface corresponding to the outside surface of the base member, an end edge of the base member with wall members attached is bevelled between the outside surface of the wall members and the inside surface of the base member so as to provide a reduced limb-contacting thickness thereat.

4. The protective device, as recited in claim 1, where the means of fastening the base member about a limb includes, where the base member has a first end and a second end:

a. two flexible connecting straps, extending from the first end of the base member in spaced relationship corresponding to the spacing of the wall members; and b. two strap receiving means attached proximate the second end of the base member.

5. The protective device, as recited in claim 4, where the connecting straps have an inside surface corresponding to the inside surface of the base member, and the wall members have an outside surface corresponding to the outside surface of the base member, there is attached to said inside surface of the connecting straps, a first fastening surface of a hook and loop fastening means and there is attached on the outside surface of the wall members, proximate the second end of the base member, a second fastening surface of the hook and loop fastening means.

6. The protective device, as recited in claim 4, where a connecting strap is attached to the base member so as to be vertically aligned with a wall member, said connecting strap formed, when attached, to increase the effective height of the wall member above the base member, thereby enhancing the retention of the restraining device between the wall members.

7. The protective device, as recited in claim 4, where the connecting straps are attached between the base member and the wall member along the entire length of the wall member.

* * * * *